US012234561B2

(12) United States Patent
Posner et al.

(10) Patent No.: US 12,234,561 B2
(45) Date of Patent: Feb. 25, 2025

(54) METHOD FOR THE CLEANING AND/OR ANTI-CORROSION PRETREATMENT OF A PLURALITY OF COMPONENTS COMPRISING ZINC-COATED (ZM) STEEL

(71) Applicant: Henkel AG & Co. KGaA, Duesseldorf (DE)

(72) Inventors: Ralf Posner, Dormagen (DE); Kristof Wapner, Duesseldorf (DE); Christian Kolt, Duesseldorf (DE); Silvia Schmidt, Hilden (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 18/602,395

(22) Filed: Mar. 12, 2024

(65) Prior Publication Data

US 2024/0263315 A1 Aug. 8, 2024

Related U.S. Application Data

(63) Continuation of application No. PCT/EP2022/075028, filed on Sep. 8, 2022.

(30) Foreign Application Priority Data

Sep. 13, 2021 (EP) ..... 21196358

(51) Int. Cl.
*C23G 1/19* (2006.01)
*C23G 3/02* (2006.01)

(52) U.S. Cl.
CPC ..... *C23G 1/19* (2013.01); *C23G 3/023* (2013.01)

(58) Field of Classification Search
CPC ..... C23G 1/19; C23G 3/023
See application file for complete search history.

(56) References Cited

U.S. PATENT DOCUMENTS

| | | | | |
|---|---|---|---|---|
| 3,826,428 | A * | 7/1974 | Fergusson | B05B 3/1007 239/222.11 |
| 10,287,665 | B2 * | 5/2019 | Giordani | C23C 2/06 |
| 2016/0010216 | A1 | 1/2016 | Allely et al. | |
| 2016/0168683 | A1 | 6/2016 | Machado Amorim et al. | |
| 2017/0314138 | A1 * | 11/2017 | Hoshino | C23C 22/83 |

FOREIGN PATENT DOCUMENTS

| | | | | |
|---|---|---|---|---|
| CA | 2864467 | * | 8/2013 | |
| CN | 1478923 | A | 3/2004 | |
| CN | 102418108 | A | 4/2012 | |
| CN | 108588730 | A | 9/2018 | |
| EP | 0091627 | A2 | 10/1983 | |
| GB | 1090310 | A * | 11/1967 | |
| RU | 2727391 | C1 | 7/2020 | |
| WO | WO-2014037234 | A1 * | 3/2014 | C23C 22/07 |

OTHER PUBLICATIONS

Machine Translation of EP0091627A2 (Year: 1983).*
Machine Translation of EP2631333A1 (Year: 2013).*
International Search Report for International Application PCT/EP2022/075028, mailed Feb. 13, 2023.

* cited by examiner

*Primary Examiner* — Sharidan Carrillo
(74) *Attorney, Agent, or Firm* — Mary K. Cameron

(57) ABSTRACT

The present invention relates to a method for the cleaning and/or anti-corrosion pretreatment of a plurality of components in series, in which the components of the series are at least partially composed of zinc-coated (ZM) steel. After a cleaning stage and before further cleaning and/or anti-corrosion pretreatment, the components pass through a treatment stage for improving the wettability of the zinc-coated (ZM) steel surfaces in which at least the surfaces of the zinc-coated (ZM) steel of the components are brought into contact with an aqueous medium which contains at least one builder which is a salt of a Lewis acid-base pair in which the Lewis acid is selected from $Li^+$, $Na^+$, $K^+$, $Ca^{2+}$, $Mg^{2+}$ or $Al^{3+}$, and the Lewis base is selected from anions of a polyprotic Brønsted acid.

18 Claims, No Drawings

METHOD FOR THE CLEANING AND/OR ANTI-CORROSION PRETREATMENT OF A PLURALITY OF COMPONENTS COMPRISING ZINC-COATED (ZM) STEEL

The present invention relates to a method for the cleaning and/or anti-corrosion pretreatment of a plurality of components in series, in which the components of the series are at least partially composed of zinc-coated (ZM) steel. For this purpose, after a cleaning stage and before further cleaning and/or anti-corrosion pretreatment, the components pass through a treatment stage for improving the wettability of the zinc-coated (ZM) steel surfaces in which at least the surfaces of the zinc-coated (ZM) steel of the components are brought into contact with an aqueous medium which contains at least one builder which is a salt of a Lewis acid-base pair in which the Lewis acid is selected from $Li^+$, $Na^+$, $K^+$, $Ca^{2+}$, $Mg^{2+}$ or $Al^{3+}$. and the Lewis base is selected from anions of a polyprotic Brønsted acid. The total concentration of the builders in the treatment stage for wetting is at least 0.4 mol/kg.

In automotive manufacturing, the use of zinc coatings on steel alloyed with magnesium is gaining importance due to the increasing demand for bodies in lightweight construction. Compared to other hot dip zinc-coatings, a coating of zinc and magnesium gives a significantly increased anti-corrosion effect and excellent resistance to corrosive delamination, in particular also after painting with organic dip coating materials. Due to this improved property profile, coatings in a smaller layer thickness can be provided, which nevertheless meet the high demands on overpaintability and corrosion protection. The weight saving associated with the smaller layer thickness makes it possible for hot-dip zinc-coated (ZM) steel to provide a comparatively resource-saving strip material for the manufacture of bodies in lightweight construction, so that the surface area fraction of this material in the bodywork is further increased in addition to the surface area fraction of other lightweight metals such as aluminum, in automotive manufacturing.

The metal coating realized with hot-dip zinc-coated (ZM) steel strip contains approximately 1.5 to 8 wt. % of the metals aluminum and magnesium, the proportion of magnesium being at least 0.2 wt. %. The basic suitability of these coatings in conventional methods established in the prior art for being shaped, pretreated and coated are recognized and demonstrated in principle (Characteristic Properties 095 E, "Continuously Hot-Dip Coated Steel Strip and Sheet", Chapters 8 and 10, 2017 edition, Wirtschaftsvereinigung Stahl), but on the basis of the particular composition of the coating and the native oxide layer, there are special features which have to be taken into account, in particular in the case of cleaning and pretreatment, for a coating result which is as homogeneous and reproducible as possible and thus optimal anti-corrosion characteristics or the desired surface functionality.

It is known from the prior art, for example, that in the course of cleaning, a change in the proportion of the oxides of the alloy component magnesium, before an anti-corrosion pretreatment of hot-dip zinc-coated (ZM) strip steel, can be advantageous. For example, US 2016/0168683 A1 reports that a treatment step using an acidic aqueous composition, which follows the cleaning, is able to change the nature of the oxide layer in such a way that, as a result of the subsequent conversion treatment, better anti-corrosion coatings result. Aqueous solutions of hydrochloric acid, phosphoric acid and sulfuric acid are cited as suitable acidic compositions that ultimately reduces the proportion of magnesium in the near-surface oxide layer. US 2016/0010216 A1 also describes that the reduction of magnesium oxide in the near-surface oxide layer of hot-dip zinc-coated (ZM) strip steel is advantageous for the anti-corrosion pretreatment and proposes, for this purpose, a treatment of the strip steel with a neutral or alkaline aqueous composition containing a complexing agent for magnesium, which treatment is associated with the degreasing or follows this. The proposed complexing agents are selected from organic acids or their salts and preferably selected from glycine and diphosphoric acid. In the examples cited there, it is shown that the proportion of magnesium oxide near the surface can be reduced, according to the teaching therein, on the basis of a commercial cleaner for degreasing by additivation of glycine.

In the series treatment of components which have surfaces of hot-dip zinc-coated (ZM) steel, the method-related problem frequently also arises that the surfaces no longer wet completely when the components are brought into contact with the wet-chemical treatment steps of a cleaning or anti-corrosion pretreatment. In the stationary operation of a line for surface treatment of components comprising surfaces of (ZM), a consistent and satisfactory result can therefore often hardly be ensured or requires complex bath care.

In this context, the object of the present invention is on the one hand to optimally condition the surface, formed by hot-dip zinc-coated (ZM) steel, for subsequent cleaning and anti-corrosion pretreatment, and on the other hand to ensure the wettability of these surfaces in the series treatment of a plurality of components in uniform quality, so that a subsequent wet-chemical treatment step, which can be a cleaning step and/or an anti-corrosion pretreatment, can be carried out with the same success.

This object is achieved by a method for cleaning and/or anti-corrosion pretreatment of a plurality of components in series, in which the components of the series are at least partially composed of zinc-coated (ZM) steel and in which the components of the series each pass through the successive method steps i)-iii):

i) bringing the components into contact with an aqueous cleaning solution having a pH of greater than 7.0 and containing at least one surfactant;

ii) bringing at least the surfaces of the zinc-coated (ZM) steel of the components into contact with an aqueous agent containing at least one builder which represents a salt of a Lewis acid-base pair in which the Lewis acid is selected from $Li^+$, $Na^+$, $K^+$, $Ca^{2+}$, $Mg^{2+}$ or $Al^{3+}$ and the Lewis base is selected from anions of a polyprotic Brønsted acid, and optionally at least one surfactant, the total concentration of the builders being at least 0.4 mol/kg; and iii) cleaning the components by bringing them into contact with a further aqueous cleaning solution and/or anti-corrosion pretreatment by bringing into contact with an aqueous treatment solution of a first stage of a conversion treatment.

The sequence of treatment stages i)-iii) is decisive for the success according to the invention and initially comprises a cleaning stage which serves to remove coarse soiling from the components of the series and to provide a readily wettable surface, and therefore is also referred to below as precleaning.

This precleaning follows, with or without an intermediate rinsing and/or drying step, preferably with an intermediate rinsing step, but without a drying step, the treatment stage in which at least those surfaces of the component that are the zinc-coated (ZM) steel surfaces are brought into contact with the aqueous agent containing at least one builder. Method step ii) results in a permanent wettability of the (ZM) surfaces so that the surfaces are provided optimally conditioned for subsequent cleaning and/or anti-corrosion surface treatment. Method step ii) is therefore also referred to below as conditioning.

The conditioning is followed, in the method according to the invention, as already mentioned, by the method steps necessary for the application of an anti-corrosion coating, for the application of the coating either again firstly a cleaning step being carried out or an anti-corrosion pretreatment already being carried out immediately, which is ultimately the preferred variant for considerations of method economy. As a rule, however, a specific anti-corrosion pretreatment also requires a specific prior cleaning, matched to it so that the conditioning in such a case initially follows cleaning, and subsequently a downstream anti-corrosion pretreatment follows.

In principle, the wettability of the (ZM) surfaces brought about in the conditioning is surprisingly persistent and is not impaired by a rinsing step, for example using mains water, in any manner relevant to the performance of a subsequent anti-corrosion coating. Nevertheless, it is again preferred from the economic point of view if method step iii) in the method according to the invention directly follows method step ii), i.e., without an intermediate drying step, in particular without either an intermediate drying step or rinsing step.

A "rinsing step" within the meaning of the present invention denotes a process which is intended solely to remove as far as possible, from the surface of the component, active components from an immediately preceding wet-chemical treatment step, which are dissolved in a wet film adhering to the component, by means of a rinsing solution, without replacing the active components to be removed with other active components. Active components in this context are components dissolved or dispersed in the aqueous phase, which are used up by contact with the components and the proportion and concentration of which in the respective aqueous solution therefore have to be maintained actively, i.e., by metering in by means of apparatuses provided for this purpose, above a value which is established in terms of method technology, in the course of the series treatment.

A "drying step" within the meaning of the present invention denotes a process in which the surfaces of the components that have a wet film are intended to be dried with the aid of technical measures.

Treatment of the components in series is when a plurality of components are brought into contact with treatment solution provided in the respective treatment steps i)-iii) of the method according to the invention and conventionally stored in system tanks, the individual components being brought into contact successively and thus at different times from one another. In this case, a system tank is a container in which the respective treatment solution is located for the purpose of cleaning and/or anti-corrosion pretreatment in series, but not necessarily also the location of the contacting. Thus, a portion of the treatment solution stored in a system tank, which is sufficient for bringing the (ZM) surfaces of the component into contact, can also be fed out of this and applied to the component spatially separated from the system tank, for example in a spray or misting chamber.

Treatment Stage i)—Precleaning:

The treatment stage i) serves to remove soiling, in particular drawing, forming, rolling and anti-corrosion oils from the component surfaces. Usually, and therefore preferably, the (ZM) surfaces of the components of the series, after passing through method step i), have a carbon layer of less than 0.50 g, particularly preferably less than 0.10 g, of carbon per square meter of the (ZM) surface of the components. The layer of carbon remaining on the (ZM) surfaces of the components can be determined by pyrolytic decomposition. For this purpose, a representative component portion of defined surface area is brought to 550° C. substrate temperature (PMT) in an oxygen atmosphere, and the quantity of carbon dioxide released is determined quantitatively by means of infrared sensor as an amount of carbon, for example by means of the analysis device LECO® RC-412 Multiphase Carbon Determinator (Leco Corp.).

The cleaning preceding the surface conditioning in method step ii) is carried out according to the invention by means of alkaline aqueous and surfactant-containing solutions. Surfactants within the meaning of the present invention are considered to be surface-active organic compounds which, for their surface activity, are composed of a hydrophilic and at least one lipophilic molecular component or of a lipophilic and at least one hydrophilic molecular component, the molecular weight of the surface-active organic compound not exceeding 2000 g/mol.

The surfactants in method step i) of the method according to the invention can be selected from anionic surfactants, cationic surfactants, zwitterionic surfactants and non-ionic surfactants, the use of non-ionic surfactants generally being preferred. Particularly suitable non-ionic surfactants as constituents of the aqueous agent for precleaning components comprising metal surfaces of (ZM) are those of which the HLB value (Hydrophilic-Lipophilic-Balance) is at least 8, particularly preferably at least 10, very particularly preferably at least 12, but particularly preferably not more than 18, very particularly preferably not more than 16. The HLB value serves as a quantitative reference variable for the classification of non-ionic surfactants with regard to their miscibility with water or their property of forming O/W emulsions. For quantification, a breakdown of the non-ionic surfactant into a lipophilic and a hydrophilic group is carried out. The HLB value is then calculated as follows and can assume values of zero to 20 on the arbitrary scale:

$$HLB = 20\,(1 - M_l / M) \qquad \text{(I)}$$

where $M_l$: molar mass of the lipophilic group of the non-ionic surfactant

M: molar mass of the non-ionic surfactant

In terms of substance, such non-ionic surfactants are preferred in the precleaning of the method according to the invention which are selected from alkoxylated alkyl alcohols, alkoxylated fatty amines and/or alkyl polyglycosides, particularly preferably from alkoxylated alkyl alcohols and/or alkoxylated fatty amines, very particularly preferably from alkoxylated alkyl alcohols. In this case, for a defoaming effect, the alkoxylated alkyl alcohols and/or alkoxylated fatty amines are preferably end-capped, particularly preferably having an alkyl group which in turn preferably has no more than 8 carbon atoms, particularly preferably no more than 4 carbon atoms. Particularly preferably, such alkoxylated alkyl alcohols and/or alkoxylated fatty amines are used as non-ionic surfactants for precleaning in the method according to the invention which are present ethoxylated and/or propoxylated, the number of alkylene oxide units preferably being no greater than 16, particularly preferably no greater than 12, very particularly preferably no greater than 10, but particularly preferably greater than 4, very particularly preferably greater than 6.

With regard to the lipophilic component of the non-ionic surfactants mentioned above, such alkoxylated alkyl alcohols and/or alkoxylated fatty amines are preferred as non-ionic surfactants in the precleaning of the method according to the invention of which the alkyl group is saturated and preferably unbranched, the number of carbon atoms in the alkyl group preferably being greater than 6, particularly preferably at least 10, very particularly preferably at least 12, but preferably no greater than 20, particularly preferably no greater than 18, very particularly preferably no greater than 16.

Overall, it is apparent that longer-chain non-ionic surfactants are very suitable and preferred for effective precleaning of conventional drawing, forming, rolling and anti-corrosion oils, so that in a further preferred embodiment of the method according to the invention, such alkoxylated alkyl alcohols and/or alkoxylated fatty amines, in particular the alkoxylated alkyl alcohols are preferred of which the lipophilic alkyl group comprises at least 10 carbon atoms, particularly preferably at least 12 carbon atoms, the longest carbon chain in the alkyl group consisting of at least 8 carbon atoms and an HLB value in the range from 12 to 16 being present.

Preferred representatives of the alkoxylated alkyl alcohols are selected, for example, from

- four- to eight-fold ethoxylated or propoxylated C6-C12 fatty alcohols,
- eight to twelve-fold ethoxylated C12-C18 fatty alcohols,
- six to fourteen-fold propoxylated C12-C18 fatty alcohols,
- six to ten-fold ethoxylated and propoxylated C12-C14 fatty alcohols, which can in turn be present in methyl, butyl- or benzyl-end group-closed form.

The cloud point determined according to DIN 53 917 (1981) is a further suitable selection criterion for the non-ionic surfactant to be used in the precleaning, which is selected from alkoxylated alkyl alcohols, alkoxylated fatty amines and/or alkyl polyglycosides, and is preferably above 20° C., but particularly preferably below the application temperature of the precleaning, very particularly preferably more than 5° C., but not more than 10° C., below the respectively selected application temperature of the aqueous agent for precleaning.

The proportion of the surfactants, in particular the non-ionic surfactants, in the aqueous cleaning solution of method step i) is preferably above 0.01 wt. %, particularly preferably above 0.10 wt. %, very particularly preferably above 0.20 wt. %, but preferably not above 2.00 wt. %., in each case based on the cleaning solution. If the proportion of a compound or substance is indicated as a mass-based percentage in the following, the respective solution or the respective agent is always the reference variable in the absence of other more specific information.

The application and thus the bringing into contact of the aqueous cleaning solution preferably takes place at at least 30° C., particularly preferably at least 40° C., but preferably below 60° C. The cleaning solution of the precleaning can be brought into contact with the components of the series by means of application types established in the prior art. These include in particular dipping, rinsing, splashing and/or spraying, the application in the dipping and/or spraying method being preferred.

In the method according to the invention, the pH of the aqueous cleaning solution is set to be alkaline for a sufficient precleaning, in which the components are effectively freed of oil-based soiling, but the pH is preferably not above 12.0, in order to mitigate the stripping of the metal substrates of the components. The method according to the invention is intended to be used especially in automotive manufacturing, which uses hot-dip zinc-coated (ZM) strip steel as the manufacturing material, and other materials such as steel and aluminum, so that the bodies produced in series are regularly composed of a mix of different metal materials. Since the precleaning in method step i) serves virtually exclusively for freeing the surfaces of the components of usually organic soiling—what is known as degreasing—the pH of the cleaning solution can be selected such that the lowest possible pickling effect is achieved. In this respect, it can preferably be the case for the aqueous cleaning solution that its pH is not above 11.5, particularly preferably not above 10.5, but at least pH of 8.0 is set for the degreasing effect.

Treatment Stage ii)—Conditioning

Treatment stage ii) serves to make the surfaces of the component, which are formed by hot-dip zinc-coated (ZM) steel, reliably and permanently wettable for subsequent cleaning and/or pretreatment stages, in order in this way to ensure uniform surface properties and corrosion protection for the components treated in accordance with the invention that are reproducible in the case of treatment of components in series.

The conditioning of the surfaces of (ZM) to be carried out in treatment stage ii) requires said surfaces to be brought into contact with an aqueous agent containing one or more builders, which represents a salt of a Lewis acid-base pair in which the Lewis acid is selected from $Li^+$, $Na^+$, $K^+$, $Ca^{2+}$, $Mg^{2+}$ or $Al^{3+}$, and the Lewis base is selected from anions of a polyprotic Brønsted acid.

In order to achieve a sufficient wettability of the surfaces of (ZM), it is necessary for the total concentration of these builders to be at least 0.4 mol/kg, preferably at least 0.5 mol/kg, particularly preferably at least 0.6 mol/kg. Typically, higher concentrations are not required or do not provide any further improvement in the wettability for the subsequent method steps of cleaning and/or anti-corrosion pretreatment. Significantly higher concentrations are therefore uneconomic and increase the method complexity during bath care in the subsequent treatment stages due to the carryover of builder components, which always occurs to a certain degree, by the wet film adhering to the components or by dipping components, so that the total concentration of the builders, selected from salts of such Lewis acid-base pairs of which the Lewis acid is selected from $Li^+$, $Na^+$, $K^+$, $Ca^{2+}$, $Mg^{2+}$ or $Al^{3+}$ and of which the Lewis base is selected from anions of a polyprotic Brønsted acid, preferably does not exceed 2.0 mol/kg, particularly preferably does not exceed 1.2 mol/kg, in the aqueous agent.

Builders suitable for conditioning are those in which the anions of the polyprotic Brønsted acid of the Lewis acid-base pair are selected from anions of sulfuric acid, phosphoric acid, diphosphoric acid, polyphosphoric acid, carbonic acid, particularly preferably from anions of phosphoric acid, diphosphoric acid, polyphosphoric acid, carbonic acid, very particularly preferably from anions of carbonic acid. Suitable builders can also be provided on the basis of polybasic organic acids and are then preferably selected from such Lewis acid-base pairs of which the Lewis bases are formed by polybasic carboxylic acids, particularly preferably of di- and tricarboxylic acid anions, which in turn preferably have a Hydroxyl group in the a-position to a carboxyl group, and very particularly preferably by anions of citric acid and/or tartaric acid. The proportion of such builders, the Lewis bases of which are formed by anions of organic acids, based on the total proportion of the builders, is preferably less than 50 wt. %, particularly preferably less than 30 wt. %, but preferably at least 0.05 mol/kg, in order to additionally impart a complexing effect to the conditioning agent, which is advantageous for further homogenization of the oxide coverage of the (ZM) surfaces of the components.

Particularly suitable Lewis acids for the builders contained in the aqueous agent for conditioning, which can be removed without residue by the method step ii), have been found to be the cations $Na^+$, $K^+$ and/or $Mg^{2+}$, which are therefore preferred, the Lewis acids of the builders are particularly preferably selected from $Na^+$ and/or $K^+$.

The surfaces of (ZM) of the components are conditioned sufficiently for subsequent cleaning and/or anti-corrosion pretreatment in the presence of the at least one builder, as described above. The builders described behave as far as possible indifferently in relation to the metal surfaces and their oxides, and do not form compact thin layers either by chemisorption, metalization, or by conversion due to a coupled pickling and precipitation mechanism. In this respect, for the conditioning to succeed, it is advantageous, and also desirable for economic reasons, if the proportion of further constituents of the aqueous agent is as reduced as possible.

Accordingly, the proportion of other Lewis acids, excluding $H^+$ and $NH_4^+$, based on the entirety of the Lewis acids selected from $Li^+$, $Na^+$, $K^+$, $Ca^{2+}$, $Mg^{2+}$ or $Al^{3+}$ in the aqueous conditioning agent is preferably less than 5.0 wt. %, particularly preferably less than 2.0 wt. %, very particularly preferably less than 1.0 wt. %, and most particularly preferably less than 0.5 wt. %.

Particularly preferably, in order to avoid the formation of a conversion coating, if the proportion of water-soluble compounds of the elements Zr, Ti, Hf, Ce, Cr in the aqueous conditioning agent is less than 10 mg/kg, particularly preferably less than 5 mg/kg, very particularly preferably less than 1 mg/kg, based on the respective element.

It is likewise preferred, in order to avoid the deposition of certain metal phases, if the proportion of water-soluble compounds of metal elements (Me) having a positive standard reduction potential as iron, preferably as zinc, in the aqueous conditioning agent is in each case less than 10 mg/kg, particularly preferably less than 5 mg/kg, very particularly preferably less than 1 mg/kg, based on the respective element. The standard reduction potential is the reduction potential of the electrochemical half-cell $Me/Me^{n+}$, determined against the normal hydrogen electrode $H_2/H+$ (pH=0), at a metal ion activity 1 and 20° C.

Furthermore, it is preferred, in order to avoid a chemisorbed thin layer, if the proportion of polymeric organic compounds in the aqueous conditioning agent is less than 1 wt. %, particularly preferably less than 0.1 wt. %, very particularly preferably less than 0.05 wt. %. In the context of the present invention, an organic compound is polymeric when it has a molecular weight above 1000 u.

It is particularly preferred, in order to avoid point defects due to particles adsorbed on the surfaces of (ZM) in the case of a layer build-up taking place in the course of a subsequent anti-corrosion pretreatment, if the proportion of dispersed particulate constituents in the aqueous conditioning agent is less than 1 wt. %, particularly preferably less than 0.1 wt. %, very particularly preferably less than 0.05 wt. %. The dispersed particulate constituent of the aqueous agent is that solid content which remains after drying of the retentate of ultrafiltration of a defined partial volume of the aqueous dispersion, with a nominal exclusion limit of 10 kD (NMWC, Nominal Molecular Weight Cut Off), insofar as the ultrafiltration is carried out with the addition of deionized water ($\kappa<1$ μScm-1) until a conductivity below 10 $\mu Scm^{-1}$ in the filtrate is measured.

With regard to the builders, it has been found that the additional presence of surfactants for the wetting of the components with the aqueous agent is particularly advantageous and, in interaction with the builder, a (ZM) surface is provided that is homogeneously conditioned for subsequent cleaning and/or anti-corrosion pretreatment. In this context, in turn, surfactants which are used in the precleaning in method step i) are generally preferred. This applies both with regard to quality and to the quantity of the non-ionic surfactants.

In particular for aqueous agents containing builders in which the anions of the polyprotic Brønsted acid, which functions as a Lewis base of the salt of the Lewis acid-base pair, are selected from anions of carbonic acid, the additivation of the aqueous agent with surfactants, in particular non-ionic surfactants, has proven to be advantageous.

In conjunction with builders based on anions of carbonic acid, non-ionic surfactants which are selected from

- four- to eight-fold ethoxylated or propoxylated C6-C12 fatty alcohols,
- eight to twelve-fold ethoxylated C12-C18 fatty alcohols,
- six to fourteen-fold propoxylated C12-C18 fatty alcohols, and/or
- six to ten-fold ethoxylated and propoxylated C12-C14 fatty alcohols, which in turn preferably are present in methyl, butyl- or benzyl-end group-closed form, have been found to be particularly preferred.

In a particular embodiment of the method according to the invention, it is preferred if the surfactants are selected identically in both method steps i) and ii), since in this way the components can be transferred directly, wet-in-wet, as it were, from the precleaning into the conditioning, without a rinsing step.

The pH of the aqueous conditioning agent is preferably above 6.5, particularly preferably the agent is set alkaline, but with the proviso that a strong pickling of the metal materials of the component, in particular of the surfaces of (ZM), is ideally avoided. At the same time, the method is intended to be suitable for the treatment of components which are composed of different metal manufacturing materials, in particular of those which, in addition to hot-dip zinc-coated (ZM) steel, are also composed of steel and/or aluminum, for example automobile bodies. Accordingly, it is preferred according to the invention if the pH of the aqueous conditioning agent is no greater than 10.5, particularly preferably no greater than 9.5, very particularly preferably no greater than 8.5, but is preferably at least 7.5.

The total alkalinity, in points, of the aqueous conditioning agent is preferably less than 30 points, particularly preferably less than 25 points, but preferably at least 10, particularly preferably at least 15 points. In addition, a sufficiently large buffer effect is produced via the builder or builders contained in the aqueous agent, which has been found to be advantageous for the conditioning of the hot-dip zinc-coated (ZM) surfaces. At the same time, the free alkalinity should not exceed such values which then lead to too great an attack by pickling resulting, which proves disadvantageous in particular in the case of application as a thin liquid film, and can require a further rinsing step, for example. In this respect, aqueous conditioning agents are preferred which have a free alkalinity below 10.0, particularly preferably below 8.0, very particularly preferably below 7.0. The total alkalinity or free alkalinity is determined by titrating 2 grams of the aqueous agent, diluted to 50 ml, with 0.1 n hydrochloric acid up to a pH of 3.6. The consumption of acid solution in ml indicates the point number of the total alkalinity.

Surprisingly, the way in which the aqueous agent is applied can additionally prove to be selective for a successful conditioning in a series treatment of components, since it is observed that the wettability of the surfaces of (ZM), after passing through method step ii), drops increasingly with the treated overall surface, in so far as the components of the series are treated with the same liquid volume of the conditioning agent, that is to say regularly when the treated surface per volume of the agent continuously increases with the number of treated components, as is usually the case, for example, in a dip application or also a spray application with closed circulation of the agent flowing off the components. The cause of the drop has hitherto not been fully clarified, but it is to be assumed that impurities absorbed by the aqueous agent and in particular salt load absorbed by the metal substrates by pickling are in a causal relationship with the loss of the achieved wettability of the surfaces of (ZM).

In order to counteract the drop in the wettability achieved by the conditioning of the surfaces of (ZM) during the series treatment, it is firstly advantageous if the conditioning agent is applied to the surfaces to be treated as effectively as possible and without excess quantity. In a preferred embodiment of the method according to the invention, the contacting of the surfaces of the zinc-coated (ZM) steel of the components in method step ii) is therefore carried out by dispensing the aqueous agent from a supply such that per square meter of the components of the series to be cleaned and/or protected from corrosion, in particular per square meter of the surfaces of zinc-coated (ZM) steel to be contacted, of the components of the series to be cleaned and/or protected from corrosion, no more than 1.00 liters, preferably no more than 0.50 liters, particularly preferably no more than 0.20 liters, of the aqueous agent is dispensed.

In connection with this preferred embodiment and the surface area-related dispensed quantity of the aqueous agent, the surface area of the components of the series to be cleaned and/or protected from corrosion represents the surface of the polyhedron with 12 surfaces, preferably with 6 surfaces, and is particularly preferably of the cuboid, which in each case completely encompasses the component and in so doing has the smallest surface area, each surface of the polyhedron touching the component in at least one point. If the component is an automobile body, its surface area in connection with the surface area-related dispensing of the aqueous conditioning agent is preferably that of the cuboid having the smallest surface area that completely encompasses the automobile body, each surface of the cuboid touching the automobile body in at least one point.

In this case, the dispensed quantity of the aqueous agent is to be distributed on the surfaces of (ZM) as effectively as possible, from economic considerations, without this contributing to wetting and it being ensured, for example, that liquid volume does not already flow away from the surfaces of the component immediately after application. It is accordingly preferred if the dispensing of the aqueous agent for bringing into contact in method step ii) is carried out in such a way that at least the surfaces of the zinc-coated (ZM) steel are covered by a liquid film of the aqueous agent, a surface area-based volume coating of preferably no more than 0.20 liters, particularly preferably no more than 0.10 liters, very particularly preferably no more than 0.07 liters and especially preferably no more than 0.05 liters, resulting on the surfaces of the zinc-coated (ZM) steel. The volume coating here does not refer, as in the case of the dispensed volume, to the surface area of the component that is approximated by polyhedra, but to the actual geometric surface area, wherein it is possible for the volume deposition to be determined by differential weighing after the liquid film has been discharged.

For the correspondingly preferred controlled dispensing of the aqueous conditioning agent or the correspondingly preferred limited application quantity of the aqueous agent on the surfaces of the zinc-coated (ZM) steel, it is advantageous and therefore further preferred if, in method step ii), the dispensing of the aqueous agent is carried out as a spray, as a spray mist or as a liquid film, particularly preferably as a spray and/or spray mist, especially preferably as a spray mist. The bringing into contact of the agent with the surfaces of the component as a spray and/or spray mist takes place using methods for spraying and misting established in the prior art and can be carried out in a locally limited manner by means of a spraying lance, and/or in a manner encompassing the component in part, by means of a spraying ring in which a plurality of atomizer nozzles can be installed. The spraying devices to be used for the dispensing of a spray and/or spray mist are, for example, pressure atomizers, rotary atomizers or two-substance atomizers. A liquid film can be applied to the component of the series in the direct application method by means of rollers, cloths, brushes, paintbrushes or similar tools for applying liquids, depending on the complexity and geometry of the components of the series.

The controlled application of aqueous conditioning agent, which is preferred according to the invention, is achieved particularly efficiently by setting a spray which is directed in a targeted manner onto the surfaces to be wetted, and/or by providing a spray mist by means of which the component together with the conveying frame is transported and which, at a given volume flow, is realized via such a transport path that the surfaces of the component to be wetted are exactly exposed to a closed liquid film. In this way, an extremely efficient procedure according to the previously described preferred embodiment of the method according to the invention is accessible, in which the aim of method step ii), of ensuring good wettability of the (ZM) surfaces over the entire treatment process while using as little material as possible, is reliably achieved.

In order to dispense, for example, as much aqueous conditioning agent as is necessary for a complete formation of a liquid film, it is preferred according to the invention if the agent dispensed as the spray and/or the spray mist in method step ii) has a mean droplet size of less than 100 μm, particularly preferably of less than 60 μm, very particularly preferably of less than 40 μm. In the case of average droplet sizes below 40 μm, the agent is atomized so strongly that the boundary region to aerosols is exceeded, and a spray mist is present. If the agent is further atomized and the average droplet size is reduced, the droplets are increasingly in suspension and do not follow gravity. The spray mist held in suspension is then moved along by the transport of the component through the spray chamber and partially displaced by the component so that a directed precipitation blocks the surfaces to be wetted, and the component surfaces are wetted less uniformly by a liquid film. It is therefore preferred if the dispensed conditioning agent in method step ii) has a mean droplet size of no less than 5 μm, particularly preferably no less than 10 μm.

It is also advantageous for the formation of a closed liquid film on the surfaces of the components to be brought into contact, if the spray and/or spray mist of the conditioning agent is dispensed in such a way that the average speed of the liquid droplets which have the average droplet size is less than 5 m/s, preferably less than 2 m/s, and particularly preferably less than 1 m/s. This applies in particular to sprays and/or spray mists of which the average droplet size is less than 100 μm, particularly preferably less than 60 μm, particularly preferably less than 40 μm.

According to the invention, the average droplet size and average speed of the droplets of a spray or spray mist is determined at the location of the geometric center of gravity of the polyhedron surrounding the component, which is also used for determining the quantity of the agent that is dispensed per surface area of the component, as described above. The determination can be carried out by means of light scattering and the phase Doppler anemometry.

As already described, the wettability of the (ZM) surfaces of the components achieved in method step ii) is significantly reduced, in a series treatment, when the same partial volume of the aqueous conditioning agent is repeatedly brought into contact with the surfaces of the component and is not regularly renewed. In a preferred embodiment of the method according to the invention, method step ii) is carried out in such a way that the portion of the aqueous agent that is dispensed for bringing into contact, which is not brought into contact with the component, and, for example, sinks to the bottom as excess spray and is collected there, or which, until bringing into contact with an aqueous solution in method step iii), does not remain on the same, and for example runs off the component and remains in the spray chamber, is discarded. A portion of the conditioning agent is considered to be "discarded" if it is no longer provided for bringing into contact and, for example, is removed from the spray chamber.

Treatment Stage iii)—Cleaning and/or Anti-Corrosion Pretreatment:

The method step iii), following the treatment stage for conditioning, completes the method, in that the cleaning and/or anti-corrosion pretreatment is completed. Cleaning in the sense of this method step is understood to mean wet chemical treatment using a cleaning solution, in the course of which metal surfaces of the component, but at least the surfaces of the hot-dip zinc-coated (ZM) steel substrate, are freed of adhering organic impurities, so that a carbon coating of less than 0.10 g, preferably less than 0.05 g of carbon per square meter of the (ZM) surface of the components, preferably per square meter of all metal surfaces of the component, results. Suitable cleaning solutions are described in connection with the cleaning solutions of method step i) so that preferably the same surfactants, in particular non-ionic surfactants, can also be used. Cleaning in the sense of method step iii), however, also includes treatment using cleaning solutions which, due to their pickling reactions, cause a conversion of the oxide layers of the metal surfaces. However, no cleaning in the sense of method step iii) is present if the result is a layer coating of more than 1 mg/m$^2$ with metal or semi-metal foreign elements based on the respective elements. In this case, a person skilled in the art will refer to a conversion layer formation that is to be attributed to the anti-corrosion pretreatment within the meaning of the present invention, which can either be carried out immediately after the conditioning or optionally after the previously mentioned cleaning.

In the context of the present invention, in particular passivations by means of inorganic barrier layers, which can either be crystalline (phosphating) or amorphous (chromating, conversion treatment based on Zr/Ti), can be considered as anti-corrosion pretreatment. The inorganic passivations also include the alkaline passivation in the presence of iron ions and optionally further dissolved metal ions of the elements cobalt, nickel, manganese and molybdenum as described, for example, in published patent applications DE and DE.

The present invention, which ensures a complete and permanent wettability of the (ZM) surfaces of components, is advantageous in particular for what are known as thin-film passivations, since a remaining or incomplete wettability of the (ZM) surfaces often brings about poorer corrosion protection in this passivation type. In this respect, such anti-corrosion pretreatments are preferred for method step iii) which result in a layer coating of less than 200 mg/m$^2$ with metal or semi-metal foreign elements, based on the respective elements.

A chromium-containing or preferably chromium-free conversion solution, as an aqueous treatment solution for anti-corrosion pretreatment in method step iii), can be used as such thin-film passivation. Preferred conversion solutions by which the surfaces of the components of the series can be cleaned and conditioned according to the present invention are based on hexafluoro anions of the elements Zr, Ti, Hf and/or Si.

The conversion solutions preferably additionally contain dissolved ions of the metals molybdenum, copper, bismuth and/or manganese.

Components of the Series:

According to the invention, the components comprise the material hot-dip zinc-coated (ZM) steel. In this case, the hot-dip zinc-coated (ZM) is a metal coating which contains 1.5 to 8 wt. % of the metals aluminum and magnesium, the proportion of magnesium in the metal coating preferably being at least 0.2 wt. %.

However, the method according to the invention is not limited to application to hot-dip zinc-coated (ZM) steel so that the usual substrates provided by the steel industry, such as steel, in particular cold-rolled steel (CRS), and electrolytically zinc-coated (ZE) or hot zinc-coated (Z), alloy-zinc-coated, in particular (ZF), (ZA), or aluminum-coated (AZ), (AS) steel, are also suitable as further constituents of the components. In the method according to the invention, light metals such as aluminum and magnesium and their alloys can also be treated together with the hot-dip zinc-coated (ZM) steel of the component and be cleaned and/or undergo anti-corrosion pretreatment in the process.

The different materials are generally present in the component in the form of flat products which are cut to size, shaped, and joined by welding, adhesive bonding and crimping. The components which are to be pretreated in series according to the present invention are preferably selected from automobile bodies or parts thereof, heat exchangers, profiles, pipes, tanks or troughs.

The components treated according to the invention can be supplied, in a process step following method step iii), with an organic topcoat system, in particular a dip coating, particularly preferably a cathodic electrodeposition coating.

The invention claimed is:

1. A method for cleaning and/or anti-corrosion pretreatment of a plurality of components in series, in which the components of the series are at least partially composed of zinc-coated (ZM) steel and in which the components of the series each pass through successive method steps i)-iii):

i) bringing the components into contact with an aqueous cleaning solution having a pH greater than 7.0 and containing at least one surfactant;

ii) bringing at least a surface of the zinc-coated (ZM) steel of the components from step i) into contact with an aqueous agent containing at least one builder which comprises a salt of a Lewis acid-base pair in which the Lewis acid is selected from $Li^+$, $Na^+$, $K^+$, $Ca^{2+}$, $Mg^{2+}$ or $Al^{3+}$ and the Lewis base is selected from anions of a polyprotic Brønsted acid, and optionally at least one surfactant, wherein a total concentration of the builders is at least 0.4 mol/kg, but does not exceed 2.0 mol/kg, the aqueous agent having a pH of no greater than 9.5; and iii) cleaning by bringing the components from step ii) into contact with a further aqueous cleaning solution, and/or anti-corrosion pretreatment by bringing into contact with an aqueous treatment solution of a conversion treatment.

2. The method according to claim 1, wherein the contacting of the surface of the zinc-coated (ZM) steel of the components in method step ii) is carried out by dispensing the aqueous agent from a supply in such a way that per square meter of the components of the series to be cleaned and/or protected from corrosion, no more than 1.00 liters of the aqueous agent is dispensed.

3. The method according to claim 1, wherein the anions of the polyprotic Brønsted acid of the builder in the aqueous agent of method step ii) are selected from a) anions of sulfuric acid, phosphoric acid, diphosphoric acid, polyphosphoric acid, carbonic acid; or are selected from b) anions of polybasic carboxylic acids, which optionally have a hydroxyl group in α-position to a carboxyl group.

4. The method according to claim 1, wherein the anions of the polyprotic Brønsted acid of the builder in the aqueous agent of method step ii) are selected from anions of citric acid and/or tartaric acid.

5. The method according to claim 1, wherein the Lewis acids of the builder in the aqueous agent of method step ii) are selected from $Na^+$, $K^+$ and/or $Mg^{2+}$.

6. The method according to claim 1, wherein a proportion of other Lewis acids, excluding $H^+$ and $NH_4^+$, based on the entirety of the Lewis acids selected from $Li^+$, $Na^+$, $K^+$, $Ca^{2+}$, $Mg^{2+}$ or $Al^{3+}$ in the aqueous agent of method step ii), is less than 5.0 wt. %.

7. The method according to claim 1, wherein a proportion of water-soluble compounds of elements Zr, Ti, Hf, Ce, Cr in the aqueous agent of method step ii) is less than 10 mg/kg, based on the respective element.

8. The method according to claim 1, wherein a proportion of water-soluble compounds of metal elements having a positive standard reduction potential as iron or as zinc, in the aqueous agent of method step ii) is less than 10 mg/kg, based on the metal elements having a positive standard reduction potential as iron or as zinc.

9. The method according to claim 1, wherein a proportion of polymeric organic compounds in the aqueous agent of method step ii) is less than 1 wt. %.

10. The method according to claim 1, wherein the aqueous cleaning solution of method step i) and/or the aqueous agent of method step ii) contains at least one surfactant selected from non-ionic surfactants having an HLB value of at least 8, but of no more than 18; wherein the proportion of the non-ionic surfactants, in the aqueous cleaning solution of method step i) and/or the aqueous agent of method step ii) is above 0.01 wt. %, but not above 2.00 wt. %.

11. The method according to claim 1, wherein the aqueous agent in method step ii) has a pH of at least 6.5.

12. The method of claim 1, wherein the aqueous agent contains the at least one surfactant and the at least one surfactant is non-ionic.

13. The method according to claim 2, wherein the aqueous agent for the contacting in method step ii) is dispensed such that at least the surface of the zinc-coated (ZM) steel is covered by a liquid film of the aqueous agent, a volume-based layer per square meter of no more than 0.20 liters, resulting on the surface of the zinc-coated (ZM) steel.

14. The method according to claim 2, wherein the aqueous agent is dispensed in method step ii) as a spray and/or spray mist.

15. The method according to claim 2, wherein, in method step ii), any portion of the aqueous agent that is dispensed for bringing into contact with the surface of the zinc-coated (ZM) steel, which is not brought into contact with the surface or does not remain on the surface until bringing into contact with an aqueous solution in method step iii), is discarded.

16. The method of claim 12, wherein the at least one surfactant has a HLB value of at least 8, but of no more than 18 and a proportion of the non-ionic surfactants in the aqueous agent of method step ii) is above 0.01 wt. %, but not above 2.00 wt. %.

17. The method according to claim 14, wherein the aqueous agent is a spray mist and the spray mist has droplets of having an average droplet size of the dispensed aqueous agent of less than 100 μm.

18. The method according to claim 17, wherein average an average velocity of the droplets in the spray mist is less than 5 m/s.

* * * * *